US008276689B2

(12) United States Patent
Giroux et al.

(10) Patent No.: US 8,276,689 B2
(45) Date of Patent: Oct. 2, 2012

(54) METHODS AND APPARATUS FOR DRILLING WITH CASING

(75) Inventors: Richard L. Giroux, Cypress, TX (US); Albert C. Odell, II, Kingwood, TX (US); Wei Xu, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 400 days.

(21) Appl. No.: 11/750,943

(22) Filed: May 18, 2007

(65) Prior Publication Data

US 2007/0267221 A1 Nov. 22, 2007

Related U.S. Application Data

(60) Provisional application No. 60/747,929, filed on May 22, 2006.

(51) Int. Cl.
*E21B 7/20* (2006.01)

(52) U.S. Cl. ..... 175/171; 175/257

(58) Field of Classification Search ..... 175/171, 175/257, 22, 23
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,471,526 | A | 10/1923 | Pickin |
| 1,830,625 | A | 11/1931 | Schrock |
| 1,851,289 | A | 3/1932 | Owen |
| 1,880,218 | A | 10/1932 | Simmons |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,102,555 | A | 12/1937 | Dyer |
| 2,184,681 | A | 12/1939 | Osmun et al. |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,832 | A | 3/1945 | Baker |
| 2,379,800 | A | 7/1945 | Hare |

(Continued)

FOREIGN PATENT DOCUMENTS

| | | |
|---|---|---|
| CA | 2 307 386 | 11/2000 |

(Continued)

OTHER PUBLICATIONS

U.S. Appl. No. 10/618,093, filed Jul. 11, 2003.

(Continued)

*Primary Examiner* — Kenneth L Thompson
*Assistant Examiner* — Sean Andrish
(74) *Attorney, Agent, or Firm* — Patterson & Sheridan, LLP

(57) ABSTRACT

In one embodiment, a method of forming a wellbore includes running a liner drilling assembly into the wellbore, the liner drilling assembly having a liner, a conveying member, one or more connection members, and a drilling member. The method includes temporarily suspending the liner at a location below the rig floor; releasing the conveying member and the drilling member from the liner; re-connecting the conveying member to the liner; releasing the liner from its location of temporary suspension; and advancing the liner drilling assembly.

41 Claims, 9 Drawing Sheets

U.S. PATENT DOCUMENTS

| | | | |
|---|---|---|---|
| 2,570,080 | A | 10/1951 | Stone |
| 2,621,742 | A | 12/1952 | Brown |
| 2,650,314 | A | 8/1953 | Hennigh et al. |
| 2,696,367 | A | 12/1954 | Robishaw |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,978,047 | A | 4/1961 | DeVaan |
| 3,001,585 | A | 9/1961 | Shiplet |
| 3,006,415 | A | 10/1961 | Burns et al. |
| 3,054,100 | A | 9/1962 | Jones |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,680 | A | 6/1965 | Vincent |
| 3,266,582 | A | 8/1966 | Homanick |
| 3,273,660 | A | 9/1966 | Jackson et al. |
| 3,353,599 | A | 11/1967 | Swift |
| 3,387,893 | A | 6/1968 | Hoever |
| 3,419,079 | A | 12/1968 | Current |
| 3,550,684 | A | 12/1970 | Cubberly, Jr. |
| 3,552,848 | A | 1/1971 | Van Wagner |
| 3,559,739 | A | 2/1971 | Hutchison |
| 3,575,245 | A | 4/1971 | Cordary et al. |
| 3,603,411 | A | 9/1971 | Link |
| 3,603,412 | A | 9/1971 | Kammerer, Jr. et al. |
| 3,603,413 | A | 9/1971 | Grill et al. |
| 3,621,910 | A | 11/1971 | Sanford et al. |
| 3,624,760 | A | 11/1971 | Bodine |
| 3,638,989 | A | 2/1972 | Sandquist |
| 3,656,564 | A | 4/1972 | Brown |
| 3,669,190 | A | 6/1972 | Sizer et al. |
| 3,691,624 | A | 9/1972 | Kinley |
| 3,692,126 | A | 9/1972 | Rushing et al. |
| 3,696,332 | A | 10/1972 | Dickson, Jr. et al. |
| 3,729,057 | A | 4/1973 | Werner |
| 3,760,894 | A | 9/1973 | Pitifer |
| 3,776,307 | A | 12/1973 | Young |
| 3,785,193 | A | 1/1974 | Kinley et al. |
| 3,870,114 | A | 3/1975 | Pulk et al. |
| 3,934,660 | A | 1/1976 | Nelson |
| 3,935,910 | A | 2/1976 | Gaudy et al. |
| 3,945,444 | A | 3/1976 | Knudson |
| 3,947,009 | A | 3/1976 | Nelmark |
| 3,964,552 | A | 6/1976 | Slator |
| 3,964,556 | A | 6/1976 | Gearhart et al. |
| 4,049,066 | A | 9/1977 | Richey |
| 4,054,426 | A | 10/1977 | White |
| 4,064,939 | A | 12/1977 | Marquis |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,981 | A | 7/1978 | Chaffin |
| 4,133,396 | A | 1/1979 | Tschirky |
| 4,173,457 | A | 11/1979 | Smith |
| 4,175,619 | A | 11/1979 | Davis |
| 4,182,423 | A | 1/1980 | Ziebarth et al. |
| 4,186,628 | A | 2/1980 | Bonnice |
| 4,189,185 | A | 2/1980 | Kammerer, Jr. et al. |
| 4,194,383 | A | 3/1980 | Huzyak |
| 4,202,225 | A | 5/1980 | Sheldon et al. |
| 4,227,197 | A | 10/1980 | Nimmo et al. |
| 4,241,878 | A | 12/1980 | Underwood |
| 4,277,197 | A | 7/1981 | Bingham |
| 4,281,722 | A | 8/1981 | Tucker et al. |
| 4,287,949 | A | 9/1981 | Lindsey, Jr. |
| 4,311,195 | A | 1/1982 | Mullins, II |
| 4,336,415 | A | 6/1982 | Walling |
| 4,384,627 | A | 5/1983 | Ramirez-Jauregui |
| 4,392,534 | A | 7/1983 | Miida |
| 4,396,076 | A | 8/1983 | Inoue |
| 4,396,077 | A | 8/1983 | Radtke |
| 4,407,378 | A | 10/1983 | Thomas |
| 4,408,669 | A | 10/1983 | Wiredal |
| 4,413,682 | A | 11/1983 | Callihan et al. |
| 4,427,063 | A | 1/1984 | Skinner |
| 4,445,734 | A | 5/1984 | Cunningham |
| 4,460,053 | A | 7/1984 | Jurgens et al. |
| 4,463,814 | A | 8/1984 | Horstmeyer et al. |
| 4,466,498 | A | 8/1984 | Bardwell |
| 4,470,470 | A | 9/1984 | Takano |
| 4,474,243 | A | 10/1984 | Gaines |
| 4,483,399 | A | 11/1984 | Colgate |
| 4,489,793 | A | 12/1984 | Boren |
| 4,544,041 | A | 10/1985 | Rinaldi |
| 4,545,443 | A | 10/1985 | Wiredal |
| 4,580,631 | A | 4/1986 | Baugh |
| 4,583,603 | A | 4/1986 | Dorleans et al. |
| 4,589,495 | A | 5/1986 | Langer et al. |
| 4,593,584 | A | 6/1986 | Neves |
| 4,595,058 | A | 6/1986 | Nations |
| 4,605,268 | A | 8/1986 | Meador |
| 4,610,320 | A | 9/1986 | Beakley |
| 4,613,161 | A | 9/1986 | Brisco |
| 4,620,600 | A | 11/1986 | Persson |
| 4,630,691 | A | 12/1986 | Hooper |
| 4,651,837 | A | 3/1987 | Mayfield |
| 4,655,286 | A | 4/1987 | Wood |
| 4,671,358 | A | 6/1987 | Lindsey, Jr. et al. |
| 4,676,310 | A | 6/1987 | Scherbatskoy et al. |
| 4,678,031 | A | 7/1987 | Blandford et al. |
| 4,691,587 | A | 9/1987 | Farrand et al. |
| 4,693,316 | A | 9/1987 | Riggenberg et al. |
| 4,699,224 | A | 10/1987 | Burton |
| 4,708,202 | A | 11/1987 | Sukup et al. |
| 4,744,426 | A | 5/1988 | Reed |
| 4,760,882 | A | 8/1988 | Novak |
| 4,770,259 | A | 9/1988 | Jansson |
| 4,775,009 | A | 10/1988 | Wittrisch et al. |
| 4,778,008 | A | 10/1988 | Gonzalez et al. |
| 4,788,544 | A | 11/1988 | Howard |
| 4,806,928 | A | 2/1989 | Veneruso |
| 4,825,947 | A | 5/1989 | Mikolajczyk |
| 4,828,050 | A | 5/1989 | Hashimoto |
| 4,836,299 | A | 6/1989 | Bodine |
| 4,842,081 | A | 6/1989 | Parant |
| 4,854,386 | A | 8/1989 | Baker et al. |
| 4,858,705 | A | 8/1989 | Thiery |
| 4,880,058 | A | 11/1989 | Lindsey et al. |
| 4,883,125 | A | 11/1989 | Wilson et al. |
| 4,901,069 | A | 2/1990 | Veneruse |
| 4,904,119 | A | 2/1990 | Legendre et al. |
| 4,915,181 | A | 4/1990 | Labrosse |
| 4,960,173 | A | 10/1990 | Cognevich et al. |
| 4,962,822 | A | 10/1990 | Pascale |
| 5,009,265 | A | 4/1991 | Bailey et al. |
| 5,027,914 | A | 7/1991 | Wilson |
| 5,060,737 | A | 10/1991 | Mohn |
| 5,069,297 | A | 12/1991 | Krueger |
| 5,074,366 | A | 12/1991 | Karlsson et al. |
| 5,082,069 | A | 1/1992 | Seiler et al. |
| 5,085,273 | A | 2/1992 | Coone |
| 5,096,465 | A | 3/1992 | Chen et al. |
| 5,109,924 | A | 5/1992 | Jurgens et al. |
| 5,141,063 | A | 8/1992 | Quesenbury |
| 5,148,875 | A | 9/1992 | Karlsson et al. |
| 5,156,213 | A | 10/1992 | George et al. |
| 5,160,925 | A | 11/1992 | Dailey et al. |
| 5,168,942 | A | 12/1992 | Wydrinski |
| 5,172,765 | A | 12/1992 | Sas-Jaworsky |
| 5,176,518 | A | 1/1993 | Hordijk et al. |
| 5,181,571 | A | 1/1993 | Mueller |
| 5,186,265 | A | 2/1993 | Henson et al. |
| 5,191,932 | A | 3/1993 | Seefried et al. |
| 5,197,553 | A | 3/1993 | Leturno |

5,224,540 A 7/1993 Streich et al.
5,234,052 A 8/1993 Coone et al.
5,255,741 A 10/1993 Alexander
5,271,468 A 12/1993 Streich et al.
5,271,472 A 12/1993 Leturno
5,285,008 A 2/1994 Sas-Jaworsky et al.
5,285,204 A 2/1994 Sas-Jaworsky
5,291,956 A 3/1994 Mueller et al.
5,305,830 A 4/1994 Wittrisch
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,048 A 7/1994 Underwood et al.
5,343,950 A 9/1994 Hale et al.
5,343,951 A 9/1994 Cowan et al.
5,343,968 A 9/1994 Glowka
5,353,872 A 10/1994 Wittrisch
5,355,967 A 10/1994 Mueller et al.
5,361,859 A 11/1994 Tibbitts
5,375,668 A 12/1994 Hallundbaek
5,379,835 A 1/1995 Streich
5,392,715 A 2/1995 Pelrine
5,394,823 A 3/1995 Lenze
5,402,856 A 4/1995 Warren et al.
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,462,120 A 10/1995 Gondouin
5,472,057 A 12/1995 Winfree
5,477,925 A 12/1995 Trahan et al.
5,494,122 A 2/1996 Larsen et al.
5,501,280 A 3/1996 Brisco
5,520,255 A 5/1996 Barr et al.
5,526,880 A 6/1996 Jordan, Jr. et al.
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,582,259 A 12/1996 Barr
5,611,397 A 3/1997 Wood
5,613,567 A 3/1997 Hudson
5,615,747 A 4/1997 Vail, III
5,651,420 A 7/1997 Tibbitts et al.
5,655,602 A 8/1997 Collins
5,662,170 A 9/1997 Donovan et al.
5,662,182 A 9/1997 McLeod et al.
5,667,023 A 9/1997 Harrell et al.
5,685,373 A 11/1997 Collins et al.
5,697,442 A 12/1997 Baldridge
5,706,905 A 1/1998 Barr
5,717,334 A 2/1998 Vail, III et al.
5,720,356 A 2/1998 Gardes
5,730,221 A 3/1998 Longbottom et al.
5,730,471 A 3/1998 Schulze-Beckinghausen et al.
5,732,776 A 3/1998 Tubel et al.
5,743,344 A 4/1998 McLeod et al.
5,755,299 A 5/1998 Langford, Jr. et al.
5,765,638 A 6/1998 Taylor
5,785,134 A 7/1998 McLeod et al.
5,787,978 A 8/1998 Carter et al.
5,791,416 A 8/1998 White et al.
5,803,666 A 9/1998 Keller
5,813,456 A 9/1998 Milner et al.
5,823,264 A 10/1998 Riggenberg
5,826,651 A 10/1998 Lee et al.
5,828,003 A 10/1998 Thomeer et al.
5,829,520 A 11/1998 Johnson
5,829,539 A 11/1998 Newton et al.
5,836,409 A 11/1998 Vail, III
5,839,515 A 11/1998 Yuan et al.
5,839,519 A 11/1998 Spedale, Jr.
5,842,149 A 11/1998 Harrell et al.
5,845,722 A 12/1998 Makohl et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,540 A 4/1999 Pia et al.
5,894,897 A 4/1999 Vail, III
5,907,664 A 5/1999 Wang et al.
5,908,049 A 6/1999 Williams et al.
5,913,337 A 6/1999 Williams et al.
5,921,285 A 7/1999 Quigley et al.
5,921,332 A 7/1999 Spedale, Jr.
5,947,213 A 9/1999 Angle et al.
5,950,742 A 9/1999 Caraway
5,954,131 A 9/1999 Sallwasser
5,957,225 A 9/1999 Sinor
5,984,007 A 11/1999 Yuan et al.
5,988,273 A 11/1999 Monjure et al.
6,024,169 A 2/2000 Haugen
6,026,911 A 2/2000 Angle et al.
6,035,953 A 3/2000 Rear
6,059,051 A 5/2000 Jewkes et al.
6,059,053 A 5/2000 McLeod
6,061,000 A 5/2000 Edwards
6,062,326 A 5/2000 Strong et al.
6,079,498 A 6/2000 Lima et al.
6,085,838 A 7/2000 Vercaemer et al.
6,089,323 A 7/2000 Newman et al.
6,106,200 A 8/2000 Mocivnik et al.
6,135,208 A 10/2000 Gano et al.
6,155,360 A 12/2000 McLeod
6,158,531 A 12/2000 Vail, III
6,172,010 B1 1/2001 Argillier et al.
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,206,112 B1 3/2001 Dickinson, III et al.
6,216,533 B1 4/2001 Woloson et al.
6,220,117 B1 4/2001 Butcher
6,223,823 B1 5/2001 Head
6,224,112 B1 5/2001 Eriksen et al.
6,234,257 B1 5/2001 Ciglenec et al.
6,244,363 B1 6/2001 McLeod
6,263,987 B1 7/2001 Vail, III
6,273,189 B1 8/2001 Gissler et al.
6,275,938 B1 8/2001 Bond et al.
6,276,450 B1 8/2001 Seneviratne
6,290,432 B1 9/2001 Exley et al.
6,296,066 B1 10/2001 Terry et al.
6,305,469 B1 10/2001 Coenen et al.
6,311,792 B1 11/2001 Scott et al.
6,334,376 B1 1/2002 Torres
6,336,507 B1 1/2002 Collins
6,343,649 B1 2/2002 Beck et al.
6,347,674 B1 2/2002 Bloom et al.
6,357,485 B2 3/2002 Quigley et al.
6,359,569 B2 3/2002 Beck et al.
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,633 B1 4/2002 Moore
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,574 B1 7/2002 Wardley et al.
6,415,877 B1 7/2002 Fincher et al.

| | | | |
|---|---|---|---|
| 6,419,014 | B1 | 7/2002 | Meek et al. |
| 6,419,033 | B1 | 7/2002 | Hahn et al. |
| 6,427,776 | B1 | 8/2002 | Hoffman et al. |
| 6,429,784 | B1 | 8/2002 | Beique et al. |
| 6,443,241 | B1 | 9/2002 | Juhasz et al. |
| 6,443,247 | B1 | 9/2002 | Wardley |
| 6,446,723 | B1 | 9/2002 | Ramons et al. |
| 6,464,004 | B1 | 10/2002 | Crawford et al. |
| 6,464,011 | B2 | 10/2002 | Tubel |
| 6,484,818 | B2 | 11/2002 | Alft et al. |
| 6,494,272 | B1 | 12/2002 | Eppink et al. |
| 6,497,280 | B2 | 12/2002 | Beck et al. |
| 6,497,289 | B1 | 12/2002 | Cook et al. |
| 6,527,064 | B1 | 3/2003 | Hallundbaek |
| 6,536,522 | B2 | 3/2003 | Birckhead et al. |
| 6,536,993 | B2 | 3/2003 | Strong et al. |
| 6,538,576 | B1 | 3/2003 | Schultz et al. |
| 6,540,025 | B2 | 4/2003 | Scott et al. |
| 6,543,552 | B1 | 4/2003 | Metcalfe et al. |
| 6,547,017 | B1 | 4/2003 | Vail, III |
| 6,554,063 | B2 | 4/2003 | Ohmer |
| 6,554,064 | B1 | 4/2003 | Restarick et al. |
| 6,571,868 | B2 | 6/2003 | Victor |
| 6,585,040 | B2 | 7/2003 | Hanton et al. |
| 6,591,905 | B2 | 7/2003 | Coon |
| 6,612,383 | B2 | 9/2003 | Desari et al. |
| 6,619,402 | B1 | 9/2003 | Amory et al. |
| 6,634,430 | B2 | 10/2003 | Dawson et al. |
| 6,640,903 | B1 | 11/2003 | Cook et al. |
| 6,655,460 | B2 | 12/2003 | Bailey et al. |
| 6,666,274 | B2 | 12/2003 | Hughes |
| 6,668,937 | B1 | 12/2003 | Murray |
| 6,698,595 | B2 | 3/2004 | Norell et al. |
| 6,702,029 | B2 | 3/2004 | Metcalfe et al. |
| 6,702,040 | B1 | 3/2004 | Sensenig |
| 6,705,413 | B1 | 3/2004 | Tessari |
| 6,708,769 | B2 | 3/2004 | Haugen et al. |
| 6,715,430 | B2 | 4/2004 | Choi et al. |
| 6,719,071 | B1 | 4/2004 | Moyes |
| 6,722,559 | B1 | 4/2004 | Millar et al. |
| 6,725,917 | B2 | 4/2004 | Metcalfe |
| 6,725,919 | B2 | 4/2004 | Cook et al. |
| 6,725,924 | B2 | 4/2004 | Davidson et al. |
| 6,732,822 | B2 | 5/2004 | Slack et al. |
| 6,742,584 | B1 | 6/2004 | Appleton |
| 6,742,591 | B2 | 6/2004 | Metcalfe |
| 6,742,606 | B2 | 6/2004 | Metcalfe et al. |
| 6,745,834 | B2 | 6/2004 | Davis et al. |
| 6,752,211 | B2 | 6/2004 | Dewey et al. |
| 6,758,278 | B2 | 7/2004 | Cook et al. |
| 6,776,233 | B2 | 8/2004 | Meehan |
| 6,802,374 | B2 | 10/2004 | Edgar et al. |
| 6,837,313 | B2 | 1/2005 | Hosie et al. |
| 6,845,820 | B1 | 1/2005 | Hebert et al. |
| 6,848,517 | B2 | 2/2005 | Wardley |
| 6,854,533 | B2 | 2/2005 | Galloway |
| 6,857,486 | B2 | 2/2005 | Chitwood et al. |
| 6,857,487 | B2 | 2/2005 | Galloway et al. |
| 6,863,129 | B2 | 3/2005 | Ohmer et al. |
| 6,868,906 | B1 | 3/2005 | Vail, III et al. |
| 6,877,553 | B2 | 4/2005 | Cameron |
| 6,889,772 | B2 | 5/2005 | Buytaert et al. |
| 6,892,819 | B2 | 5/2005 | Cook et al. |
| 6,896,075 | B2 | 5/2005 | Haugen et al. |
| 6,899,186 | B2 | 5/2005 | Galloway et al. |
| 6,920,932 | B2 | 7/2005 | Zimmerman |
| 6,923,255 | B2 | 8/2005 | Lee |
| 6,941,652 | B2 | 9/2005 | Echols et al. |
| 6,953,096 | B2 | 10/2005 | Gledhill et al. |
| 7,000,695 | B2 | 2/2006 | Steele et al. |
| 7,004,264 | B2 | 2/2006 | Simpson et al. |
| 7,013,992 | B2 | 3/2006 | Tessari et al. |
| 7,013,997 | B2 | 3/2006 | Vail, III |
| 7,036,610 | B1 | 5/2006 | Vail, III |
| 7,040,420 | B2 | 5/2006 | Vail, III |
| 7,044,241 | B2 | 5/2006 | Angman |
| 7,048,050 | B2 | 5/2006 | Vail, III et al. |
| 7,066,267 | B2 | 6/2006 | Hall |
| 7,082,997 | B2 | 8/2006 | Slack |
| 7,083,005 | B2 | 8/2006 | Galloway et al. |
| 7,090,004 | B2 | 8/2006 | Warren et al. |
| 7,093,675 | B2 | 8/2006 | Pia |
| 7,096,982 | B2 | 8/2006 | McKay et al. |
| 7,100,710 | B2 | 9/2006 | Vail, III |
| 7,100,713 | B2 | 9/2006 | Tulloch |
| 7,108,072 | B2 | 9/2006 | Cook et al. |
| 7,108,080 | B2 | 9/2006 | Tessari et al. |
| 7,108,083 | B2 | 9/2006 | Simonds et al. |
| 7,108,084 | B2 | 9/2006 | Vail, III |
| 7,117,957 | B2 | 10/2006 | Metcalfe et al. |
| 7,124,825 | B2 | 10/2006 | Slack |
| 7,128,154 | B2 | 10/2006 | Giroux et al. |
| 7,137,454 | B2 | 11/2006 | Pietras |
| 7,140,443 | B2 | 11/2006 | Beierbach et al. |
| 7,140,455 | B2 | 11/2006 | Walter et al. |
| 7,143,847 | B2 | 12/2006 | Pia |
| 7,147,068 | B2 | 12/2006 | Vail, III |
| 7,159,668 | B2 | 1/2007 | Herrera |
| 7,165,634 | B2 | 1/2007 | Vail, III |
| 7,195,085 | B2 | 3/2007 | Pia |
| 7,216,727 | B2 | 5/2007 | Wardley |
| 7,219,727 | B2 | 5/2007 | Slack et al. |
| 7,219,730 | B2 | 5/2007 | Tilton et al. |
| 7,234,526 | B2 | 6/2007 | Steele et al. |
| 7,234,546 | B2 | 6/2007 | Vincent et al. |
| 7,240,728 | B2 | 7/2007 | Cook et al. |
| 7,311,148 | B2 | 12/2007 | Giroux et al. |
| 7,819,204 | B2 | 10/2010 | Bamford |
| 2002/0066556 | A1 | 6/2002 | Goode et al. |
| 2003/0042022 | A1 | 3/2003 | Lauritzen et al. |
| 2003/0056991 | A1 | 3/2003 | Hahn et al. |
| 2003/0070841 | A1 | 4/2003 | Merecka et al. |
| 2003/0111271 | A1* | 6/2003 | Dallas ..... 175/423 |
| 2003/0183424 | A1 | 10/2003 | Tulloch |
| 2004/0011534 | A1 | 1/2004 | Simonds et al. |
| 2004/0060700 | A1 | 4/2004 | Vert et al. |
| 2004/0216892 | A1 | 11/2004 | Giroux et al. |
| 2004/0221997 | A1* | 11/2004 | Giroux et al. ..... 166/380 |
| 2004/0238218 | A1 | 12/2004 | Runia et al. |
| 2004/0244992 | A1 | 12/2004 | Carter et al. |
| 2004/0245020 | A1 | 12/2004 | Giroux et al. |
| 2004/0262013 | A1 | 12/2004 | Tilton et al. |
| 2005/0051343 | A1 | 3/2005 | Pietras et al. |
| 2005/0152749 | A1 | 7/2005 | Anres et al. |
| 2005/0183892 | A1 | 8/2005 | Oldham et al. |
| 2005/0274547 | A1 | 12/2005 | Fincher et al. |
| 2006/0070771 | A1 | 4/2006 | McClaim et al. |
| 2007/0068703 | A1 | 3/2007 | Tessari et al. |
| 2007/0079995 | A1 | 4/2007 | McClain et al. |

FOREIGN PATENT DOCUMENTS

| | | |
|---|---|---|
| CA | 2 335 192 | 11/2001 |
| DE | 3 213 464 | 10/1983 |
| DE | 3 918 132 | 12/1989 |
| DE | 4 133 802 | 10/1992 |
| EP | 0 235 105 | 9/1987 |
| EP | 0 265 344 | 4/1988 |
| EP | 0 426 123 | 5/1991 |
| EP | 0 462 618 | 12/1991 |
| EP | 0 554 568 | 8/1993 |
| EP | 0 571 045 | 11/1993 |
| EP | 0 790 386 | 8/1997 |
| EP | 0 881 354 | 4/1998 |
| EP | 0 962 384 | 12/1999 |
| EP | 1 006 260 | 6/2000 |
| EP | 1 050 661 | 11/2000 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 733596 | 7/1955 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |

| | | |
|---|---|---|
| GB | 1 448 304 | 9/1976 |
| GB | 2 115 940 | 9/1983 |
| GB | 2 170 528 | 8/1986 |
| GB | 2 216 926 | 10/1989 |
| GB | 2 221 482 | 2/1990 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 348 223 | 9/2000 |
| GB | 2 349 401 | 11/2000 |
| GB | 2 357 101 | 6/2001 |
| GB | 2 352 747 | 7/2001 |
| GB | 2 372 765 | 9/2002 |
| GB | 2 382 361 | 5/2003 |
| GB | 2 389 130 | 12/2003 |
| JP | 2001-173349 | 6/2001 |
| WO | WO 82-01211 | 4/1982 |
| WO | WO 92-01139 | 1/1992 |
| WO | WO 98-09053 | 3/1998 |
| WO | WO 99-50528 | 10/1999 |
| WO | WO 00-28188 | 5/2000 |
| WO | WO 00-46484 | 8/2000 |
| WO | WO 00-50732 | 8/2000 |
| WO | WO 00-66879 | 11/2000 |
| WO | WO 02-14649 | 2/2002 |
| WO | WO 02-44601 | 6/2002 |
| WO | WO 02-086287 | 10/2002 |
| WO | WO 03/076762 | 9/2003 |
| WO | WO 03-087525 | 10/2003 |
| WO | WO 2006/012186 | 2/2006 |

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Driling are Options" Drilling Contractor, Jan./Feb. 2002, pp. 52.
M. Gelfgat, "Retractable Bits Development and Application" Transactions of the ASME, vol. 120, Jun. 1998, pp. 124-130.
Dean E. Gaddy, Editor, "Russia Shares Technical Know-How with U.S." Oil & Gas Journal, Mar. (1999), pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change in Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs by 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Sinor, et al., Rotary Liner Drilling for Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Madell, et al., "Casing Drilling An Innovative Approach to Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf of Mexico," Offshore, Feb. 2001, pp. 40-42.
Editor, "Tesco Finishes Field Trial Program," Drilling Contractor, Mar./Apr. 2001, p. 53.
Shephard, et al., Casing Drilling: An Emerging Technology, SPE Drilling & Completion, Mar. 2002, pp. 4.14.
Shephard, et al., Casing Drilling Successfully Applied in Southern Wyoming, World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov. et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation and Stage Cementing System for Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing and Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al., "Anaconda: Joint Development Project Leads to Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association of Drilling Engineers, Mar. 2001 Conference, pp. 1-16.
Coats, et al., "The Hybrid Drilling Unite: An Overview of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management and Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing and Hydraulic Workover Technologies Into One Integrated Drilling System, " IADC/SPE Paper 74538, IADC/SPE Drilling Conference, Feb. 26-28, 2002, pp. 1-7.
Galloway, "Rotary Drilling With Casing—A Field Proven Method of Reducing Wellbore Construction Cost," Paper WOCD-030609, World Oil Casing Drilling Technical Conference, Mar. 6-7, 2003, pp. 1-7.

McKay, et al., "New Developments In The Technology of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances to Floating Drilling Unit With Surface BOP Employed," Paper WOCD-0307-01, World Oil Casing Drilling Technical Conferece, Mar. 6-7, 2003, pp. 1-7.
Maute, "Electrical Logging: State-of-the Art," The Log Analyst, May-Jun. 1992, pp. 206-227.
Evans, et al., "Development And Testing Of An Economical Casing Connection for Use in Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Valves Wellhead Equipment Safety Systems, W-K-M Division, ACF Industries, Catalog 80, 1980, 5 Pages.
Alexander Sas-Jaworsky and J. G. Williams, Development of Composite Coiled Tubing for Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 36927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way to Cement a Liner Utitizing a New Inner String Liner Cementing Process, IADC/SPE 39349, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters and Maturing Properities, IBP 27500, Brazilian Petroleum Institute—IBP, 2000.
Tessari, Robert M., Warren, Tommy, and Houtchens, Bruce, Retrievable Tools Provide Flexibility for Casing Drilling, World Oil, Casing Drilling Technical Conference, WOCD-0306-01, 2003, pp. 1-11.
Multilateral Case History, Onshore-Nigeria, Baker Hughes, 2000.
Multilateral Case History, Offshore Norway, Baker Hughes 1995.
Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.
Charles O. Vail and Verne Smith, New Developments in Air-Gas Drilling and Completions, World Oil, Part One, Nov. 1963, pp. 70-73.
Charles O. Vail and Verne Smith, New Developments in Air-Gas Drilling and Completions, World Oil, Part Two, Dec. 1963, pp. 82-86.
Canadian Office Action for Application No. 2,589,600 dated Jul. 16, 2009.
GB Examination Report for GB0709806.4 dated Jun. 30, 2010.

* cited by examiner

METHODS AND APPARATUS FOR DRILLING WITH CASING

CROSS-REFERENCE TO RELATED APPLICATION

This application claims benefit of U.S. Provisional Patent Application No. 60/747,929, filed on May 22, 2006, which application is incorporated herein by reference in its entirety.

BACKGROUND OF THE INVENTION

1. Field of the Invention

The present invention relates apparatus and methods for drilling and completing a wellbore. Particularly, the present invention relates to apparatus and methods for forming a wellbore, lining a wellbore, and circulating fluids in the wellbore. The present invention also relates to apparatus and methods for cementing a wellbore.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of casing. An annular area is thus defined between the outside of the casing and the earth formation. This annular area is filled with cement to permanently set the casing in the wellbore and to facilitate the isolation of production zones and fluids at different depths within the wellbore.

It is common to employ more than one string of casing in a wellbore. In this respect, a first string of casing is set in the wellbore when the well is drilled to a first designated depth. The well is then drilled to a second designated depth and thereafter lined with a string of casing with a smaller diameter than the first string of casing. This process is repeated until the desired well depth is obtained, each additional string of casing resulting in a smaller diameter than the one above it. The reduction in the diameter reduces the cross-sectional area in which circulating fluid may travel. Also, the smaller casing at the bottom of the hole may limit the hydrocarbon production rate. Thus, oil companies are trying to maximize the diameter of casing at the desired depth in order to maximize hydrocarbon production. To this end, the clearance between subsequent casing strings having been trending smaller because larger subsequent casings are used to maximize production.

Drilling with casing or liner is a method of forming a borehole with a drill bit attached to the same string of tubulars that will line the borehole. In other words, rather than run a drill bit on smaller diameter drill string, the bit is run at the end of larger diameter tubing or casing or liner that will remain in the wellbore and be cemented therein. The advantages of drilling with casing are obvious. Because the same string of tubulars transports the bit and lines the borehole, no separate trip out of or into the wellbore is necessary between the forming of the borehole and the lining of the borehole. Drilling with casing or liner is especially useful in certain situations where an operator wants to drill and line a borehole as quickly as possible to minimize the time the borehole remains unlined and subject to collapse or the effects of pressure anomalies, and mechanical instability.

In the drilling of offshore wells or deep wells, the length of casing or liner may be shorter than the water depth. Also, in some instances, the wellbore may be formed in stages, such as installing casing and thereafter hanging a liner from the casing. In both cases, the length of casing may not extend back to surface.

There is a need, therefore, for running a length of drill casing or liner into the hole to form the wellbore.

SUMMARY OF THE INVENTION

In one embodiment, a drilling apparatus includes a liner as a portion of the drill string. The axial and torsional loads are carried by the drill pipe and then transferred to the drilling liner by the use of a liner drilling tool. The forces are then transmitted along the liner to a latch. The loads are then transferred from the liner to the latch and attached BHA. The drilling apparatus may include an inner string that connects the liner drilling tool at the liner top to the BHA. This way, when the liner drilling tool and latch are disconnected from the liner, the drill pipe can pull the inner string and BHA from the liner and bore hole. In one embodiment, releasing and pulling the liner drilling tool also releases and pulls the BHA out of hole with the inner string. The inner string can also act as a conduit for fluid flow from the drillpipe to the BHA below. It should be noted that the fluid flow could be split between the inner string and the liner ID, or diverted so the entire flow is in the annulus between the inner string and the liner ID.

In another embodiment, a method of forming a wellbore includes running a liner into the wellbore; suspending the liner at a location below the rig floor; running a drilling bottom hole assembly through the liner on a drill string; attaching the drill string to the liner; releasing the liner from its location of suspension; and advancing the liner through the wellbore on the drill string.

The present invention relates methods and apparatus for lining a wellbore. In one embodiment, a method of forming a wellbore includes running liner drilling assembly into the wellbore, the liner drilling assembly including a liner, a conveying member, one or more connection members, and a drilling member. The method includes temporarily suspending the liner at a location below the rig floor; releasing the conveying member and the drilling member from the liner; re-connecting the conveying member to the liner; releasing the liner from its location of temporary suspension; and advancing the liner drilling assembly.

In another embodiment, an apparatus for forming a wellbore includes a liner coupled to a drilling member; a conveying member releasably connected to the liner, the conveying member adapted to supply torque to the liner; a first releasable and re-settable connection members for coupling the conveying member to the liner; and a second connection member for coupling the liner to the drilling member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

In one embodiment, a drilling apparatus includes a liner as a portion of the drill string. The axial and torsional loads are carried by the drill pipe and then transferred to the drilling liner by the use of a liner drilling tool. The forces are then transmitted along the liner to a latch. The loads are then transferred from the liner to the latch and attached BHA. The drilling apparatus may include an inner string that connects the liner drilling tool at the liner top to the BHA. This way, when the liner drilling tool and latch are disconnected from the liner, the drill pipe can pull the inner string and BHA from the liner and bore hole. In one embodiment, releasing and pulling the liner drilling tool also releases and pulls the BHA out of hole with the inner string. The inner string can also act as a conduit for fluid flow from the drill pipe to the BHA below. It should be noted that the fluid flow could be split between the inner string and the liner ID, or the fluid flow can be fully diverted to the annulus area between the inner string OD and the liner ID. In one embodiment, the fluid returning to the surface may flow through the annular area between the wellbore and the outer diameter of the liner and/or the annular area between the inner diameter of the liner and the outer diameter of the inner string.

Figure 1:
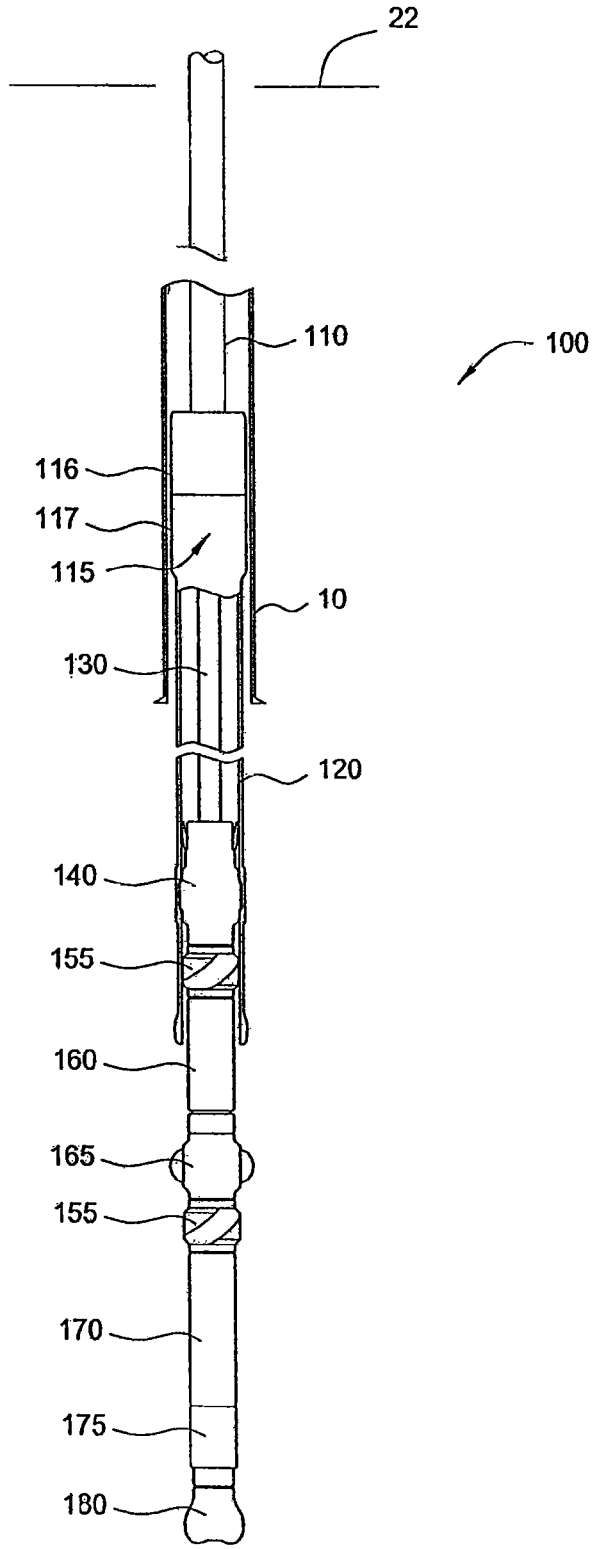
FIG. 1 shows an embodiment of the liner drilling system according to aspects of the present invention.

FIG. 1 shows an embodiment of a drilling with liner assembly of the present invention. As shown, the drilling liner assembly 100 extends below a previously installed casing 10. The drilling liner assembly 100 is run in on drill pipe 110 from the rig floor 22. A liner drilling tool 116 is used to connect the drill pipe 110 to the liner 120. The liner drilling tool 116 may be a component of the liner top assembly 115, which may also include a liner hanger 117 and a polished bore receptacle ("PBR"). In one embodiment, the liner drilling tool 116 functions as a running tool for connecting the drill pipe 110 to the liner 120. The running tool may include a latch and/or gripping members that may releasably attach and detach from the liner 120. The running/drilling tool is adapted to transmit axial and torsional forces from the drill pipe 110 to the liner 120. The running tool may be released from the liner 120 so that the BHA may be retrieved. Preferably, the running tool has torque capability that equals or exceeds the drill pipe capability and is adapted to endure typical bore hole drilling dynamics. Exemplary running tools are disclosed in U.S. Pat. Nos. 5,613,567, 5,531,273, and 6,032,734, which patents are incorporated herein by reference in their entirety. The liner top equipment (liner hanger and PBR) may also include large radial clearance for cuttings bypass and reduced equivalent circulating density ("ECD") and setting of liner hanger does not reduce the annular clearance area significantly. In one embodiment, setting of the liner hanger and release of drilling tool may be independent of the differential pressure between the inside of the tool and the outside of the liner to prevent premature activation. In another embodiment, the liner top assembly is not equipped with a packer. In yet another embodiment, the liner top assembly utilizes an expandable liner hanger.

An inner string 130 extends from the liner running/drilling tool 116 to a drilling latch 140 below. The inner string 130 may be used to convey fluid from the drill pipe 110 and/or to retrieve the BHA. Also, it should be noted that fluid may be conveyed outside of the inner string, inside of the inner string, or the flow split between both. The drilling latch 140 is adapted to releasably connect to the liner 120. An exemplary drilling latch is disclosed in U.S. Patent Application Publication No. 2004-0216892, filed on Mar. 5, 2004 by Giroux et al. having Ser. No. 10/795,214, entitled Drilling With Casing Latch, which application is herein incorporated by reference in its entirety. The drilling latch 140 is adapted to transfer axial and torsional forces from the liner 120 to the bottom hole assembly ("BHA"). The drilling latch 140 may be hydraulically, mechanically, or remotely actuated. Suitable actuating mechanism includes mud pulse technology, wire line, and fiber optics.

As shown in FIG. 1, the bottom hole assembly includes one or more stabilizers 155, a motor 160, an under-reamer 165, MWD/LWD 170, rotary steerable systems 175, and a drill bit 180. It must be noted that the BHA may include other components, in addition to or in place of the above items, such as other geophysical measurement sensors, stabilizers such as eccentric or adjustable stabilizers, steerable systems such as bent motor housing, other drill bits such as expandable bit or bits having nozzles or jetting orifices for directional drilling, or any other suitable component as is known to a person of ordinary skill in the art. Further, the components of the BHA may be arranged in any suitable order as is known to a person of ordinary skill in the art. For example, the under-reamer may be place below the motor and MWD/LWD tool.

In operation, the liner drilling tool 116 and the drilling latch 140 are actuated to engage the liner 120. The liner drilling assembly 100 is then run-in to the hole using drill pipe 110. The liner drilling assembly 100 is directionally steered to drill the hole. In this respect, the hole may be drilled and lined in the same trip. The directional steering is performed using the rotary steerable system 175. The axial and torsional forces are transferred from the drilling pipe 110 to the liner 120 through the liner running tool 116 and are then transferred from the liner 120 to the BHA through the drilling latch 140. In this respect, the inner string 130 experiences little, if any, torque that is transmitted. The inner diameter of the hole may be enlarged using the under-reamer 165. The liner drilling assembly 100 is advanced until total depth is reached. One advantage of the liner drilling assembly is that the liner protects the drilled hole during drilling. After reaching total depth, the liner hanger 117 is set to connect the liner 120 to the previously set casing. Then, the liner running tool 116 and the drilling latch 140 are released to detach from the liner 120 and are removed from the wellbore, thereby removing the BHA. In one embodiment, setting of the liner hanger 117 triggers the release of the liner running tool 116. After the BHA is retrieved, a cement operation may be performed.

In one embodiment, a cement retainer valve is tripped in and installed in the liner to enable cementing from the liner bottom. Thereafter, a conventional cementing operation may be performed. In the situation where cement cannot be circulated, a bottom squeeze may be performed. Thereafter, a second squeeze may be performed at the liner top and the liner top packer may be set in another trip into the hole.

In some circumstances, the BHA may become inoperable before total depth is reached and the BHA must be repaired or replaced. In one embodiment, the liner 120 is left in the hole and the liner drilling tool 116 and the drilling latch 140 are released. Then, the BHA is pulled out of the hole. After the BHA is repaired or replaced, the BHA is run-in to the hole and the liner drilling tool 116 and the drilling latch 140 are actuated to re-engage the liner 120. Thereafter, the drilling operation may continue by applying rotational and axial forces to the BHA. One or more BHAs may be replaced by repeating this process. It must be noted that in this embodiment, a possibility exists that the liner may become stuck during the time it takes to trip the new BHA into the hole.

In another embodiment, the liner drilling assembly 100 may be retrieved to a safe location in the wellbore. For example, the liner drilling assembly may be retrieved back to surface. The liner string 120 may then be hung on the rig floor slips. Then, the BHA may be replaced and the liner drilling assembly may be tripped back into the hole.

Figure 2:
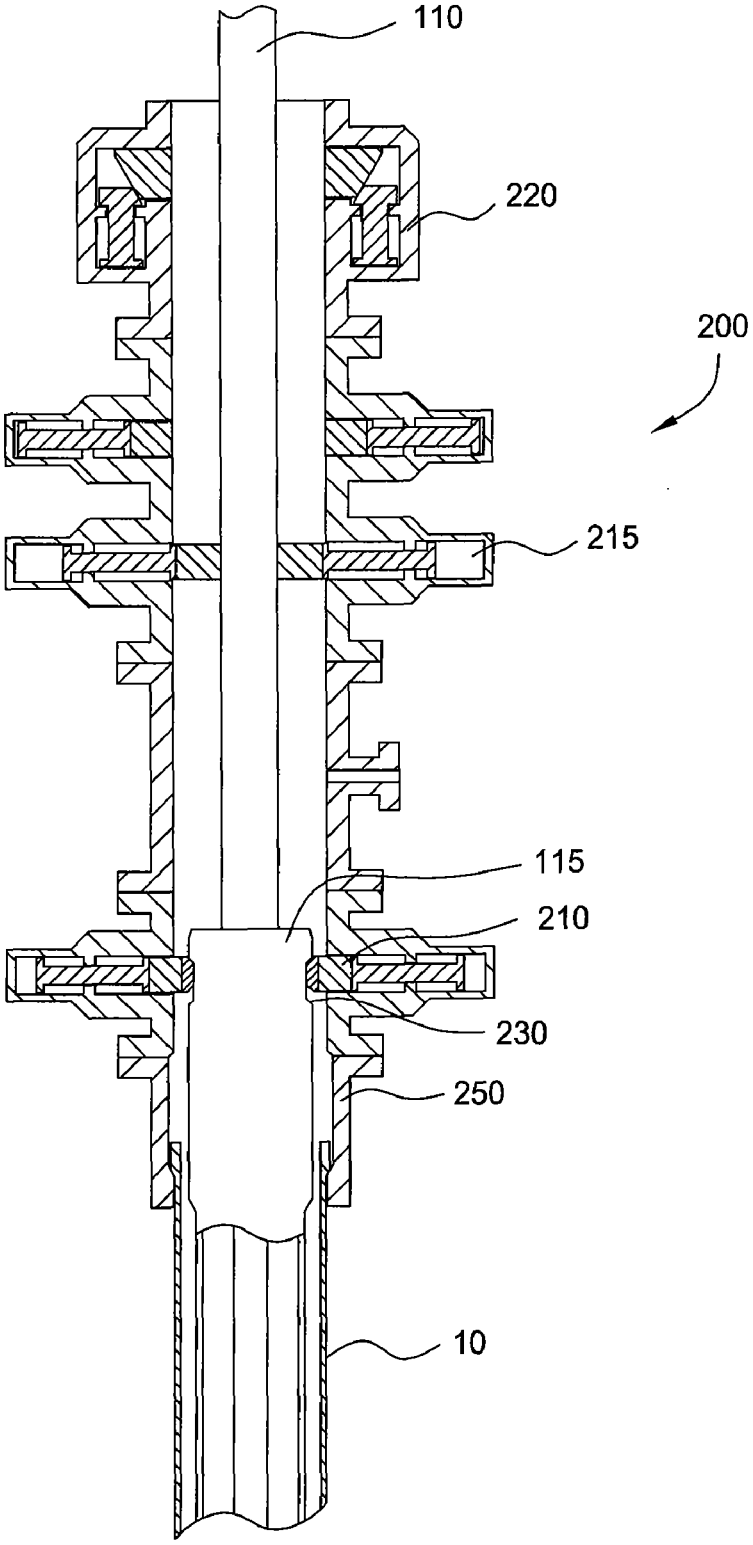
FIG. 2 shows an embodiment of the liner drilling system with the liner top suspended from a blow-out prevent ram.

In another example, the liner drilling assembly 100 may be retrieved to a position inside the previously installed casing 10. In one embodiment, the liner drilling tool 100 may be suspended just below a blow out preventer ("BOP"). FIG. 2 shows an embodiment of a BOP 200 for suspending a liner drilling assembly in a wellbore. As shown, a liner retaining BOP ram 210 is coupled to a BOP stack having a pipe ram BOP 215 and an annular BOP 220. It must be noted that the liner retaining BOP ram 210 may be integrated with or an attachment to the BOP stack. The liner top assembly 115 may include a profile 230 for engaging with the ram of the liner retaining BOP 210. The ram may be hydraulic actuated to move radially into engagement with the profile 230. Alternately, the liner top 115 may include a hanging shoulder adapted to rest on liner retaining BOP ram. The liner top 115 may be retained using a combination of a profile and/or hanging shoulder. The pipe ram BOP 215 and the annular BOP 220 are then used to close around drill pipe 110 during well control situations. In this respect, the hydraulic forces from the BOP ram are used to park the liner 120 in the wellbore. In one embodiment, one or more sensors may be used to position the liner top assembly 115 relative to the liner retaining BOP ram 210. An exemplary sensor includes a magnet. The magnet may be positioned on the liner hanger and a sensor may be mounted on the BOP ram 210 to determine the position of the magnet and thereby, the location of the liner hanger (e.g., the profile 230). It is contemplated that other suitable sensors such as RFID sensors known to a person of ordinary skill in the art may be used.

In operation, the liner drilling assembly 100 is retrieved sufficiently so that the liner top 115 is adjacent the liner retaining BOP 210. Then, hydraulic forces are applied to radially move the ram into engagement with the liner top, either by way of the profile, the hanging shoulder, or both. Once parked, the liner drilling tool 116 and the drilling latch 140 are released and the BHA is pulled out of the hole. After the BHA is repaired, the BHA is run-in and the liner drilling tool 116 and the drilling latch 140 are actuated to re-engage the liner 120. Thereafter, the ram is retracted and the liner drilling assembly 100 is released for further drilling. During operation, while the liner drilling assembly is parked in the wellhead 250, the well may experience an undesired increase in pressure. To prevent a blowout, the other BOP devices (such as pipe rams, annular preventer, and/or shear rams) may be actuated to mitigate wellbore influxes.

In another embodiment, the liner retaining BOP 210 may be used to facilitate running in the liner drilling assembly. For example, the liner may be initially run-in to the liner retaining BOP 210. Thereafter, the BHA is coupled to the drilling latch, liner running tool, and the drill pipe, and is tripped into the liner. Then, the liner running tool and the drilling latch are activated to engage the liner, thereby forming the liner drilling assembly. The retaining BOP 210 is deactivated to release the liner drilling assembly to commence drilling.

In another embodiment, the liner top assembly 115 may be adapted to engage a wall of the previously installed casing 10. The casing may include a liner receiving profile formed on an interior surface of the casing. The liner receiving profile may be adapted to engage the liner hanger of the liner drilling apparatus. In operation, the liner drilling assembly is retrieved sufficiently so that the liner top is adjacent the liner receiving profile. Then, the liner hanger is actuated to engage the profile. Once parked, the liner drilling tool and the drilling latch are released, and the BHA is pulled out of the hole. After the BHA is repaired, the BHA is run-in and the liner drilling tool and the drilling latch are actuated to re-engage the liner. Thereafter, the liner hanger is retracted and the liner drilling apparatus is released for further drilling. It is contemplated that the liner receiving profile may be formed in the previously set casing 10 or the wellhead 250. Further, it is contemplated that the drilling liner assembly may be retrieved to any suitable portion of the wellbore and suspended therein. It is further contemplated that the liner hanger may engage any portion of the casing, with or without using a liner receiving profile. In this respect, the releasable and re-settable liner hanger may be used to park/hang the liner in the previously set casing 10. The drilling liner 120 may be left in the open hole or pulled back into the set casing to prevent getting the liner stuck during the BHA replacement trip. The releasable and re-settable liner may be actuated multiple times for potentially multiple BHA trips into and out of the hole.

In another embodiment, the releasable and re-settable liner hanger may be used to facilitate run-in of the liner drilling assembly. For example, the liner equipped with a liner hanger is initially run-in to the casing. Thereafter, the liner hanger is activated to engage the casing and suspend the liner. Then, the BHA is coupled to the drilling latch, liner running tool, and the drill pipe, and is tripped into the liner. Then, the liner running tool and the drilling latch are activated to engage the liner, thereby forming the liner drilling assembly. The liner hanger is deactivated to release the liner drilling assembly to commence drilling.

In another embodiment, the liner drilling assembly may be run without using the inner string. To retrieve the BHA in the event of failure, the liner is first suspend in the wellbore using any of the above described methods of suspension. Then, a work string is lowered into the wellbore to retrieve the BHA. Exemplary work string includes drill pipe, wireline, coiled tubing, Corod (i.e., continuous rod), and any suitable retrieval mechanism known to a person of ordinary skill in the art. In one embodiment, wireline is used to retrieve the BHA. After the BHA is replaced or repaired, the BHA is lowered back into the liner and the drilling latch is activated. Then, the drill pipe may be lowered and the liner drilling tool is activated to engage an upper portion of the liner. Thereafter, the liner is released from suspension to continue the drilling operation.

Figure 3:
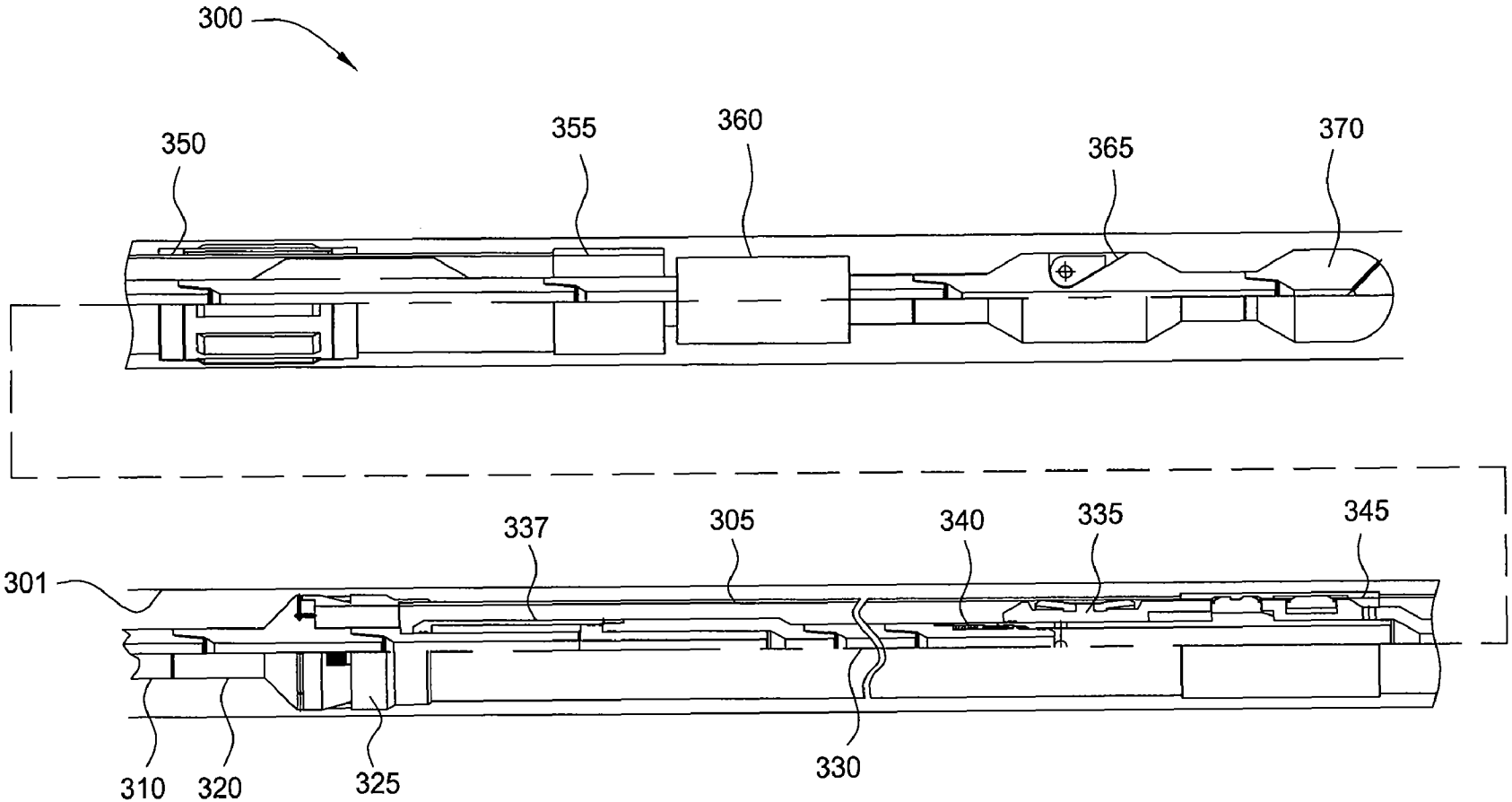
FIG. 3 shows another embodiment of a liner drilling assembly.

FIG. 3 shows, another embodiment of the liner drilling assembly 300. The liner drilling assembly 300 is connected to a drill pipe 310 using a running tool 320. The running tool 320 may releasably attach the liner 305 to the drill pipe 310 and transmit axial and torsional forces. The liner drilling assembly 300 also includes a liner hanger 325 for hanging the liner 305 in a casing 301. An inner string 330 connects the running tool 320 to the casing latch 335. In one embodiment, the inner string 330 may include a pressure and volume balanced extension joint with swivel 337. The inner string 330 may stab into the latch 335 using a spear 340, which may be provided with a seal assembly. The latch 335 is adapted to releasably attach to the latch in collar 345 of the liner 305. Any suitable latch known to a person of ordinary skill in the art may be used. One or more non-rotating or rotating centralizers 350 may be used to centralize the liner 305 relative to the casing 301 or the drilled hole. The lower end of the liner 305 may include a casing shoe 355. As shown, the BHA 360 extends below the liner 305. The BHA 360 may include a motor, MWD/LWD, and rotary steerable systems. One or more under-reamer 365 and/or pilot bit 370 may be used to form the wellbore. It must be noted that the BHA 360 may include other components, in the to or in place of above listed items, such as other geophysical measurement sensors, stabilizers such as eccentric or adjustable stabilizers, steerable systems such as bent motor housing, other drill bits such as expandable bit or bits having nozzles or jetting orifices for directional drilling, or any other suitable component as is known to a person of ordinary skill in the art. Further, the components of the BHA may be arranged in any suitable order as is known to a person of ordinary skill in the art.

Figure 4:
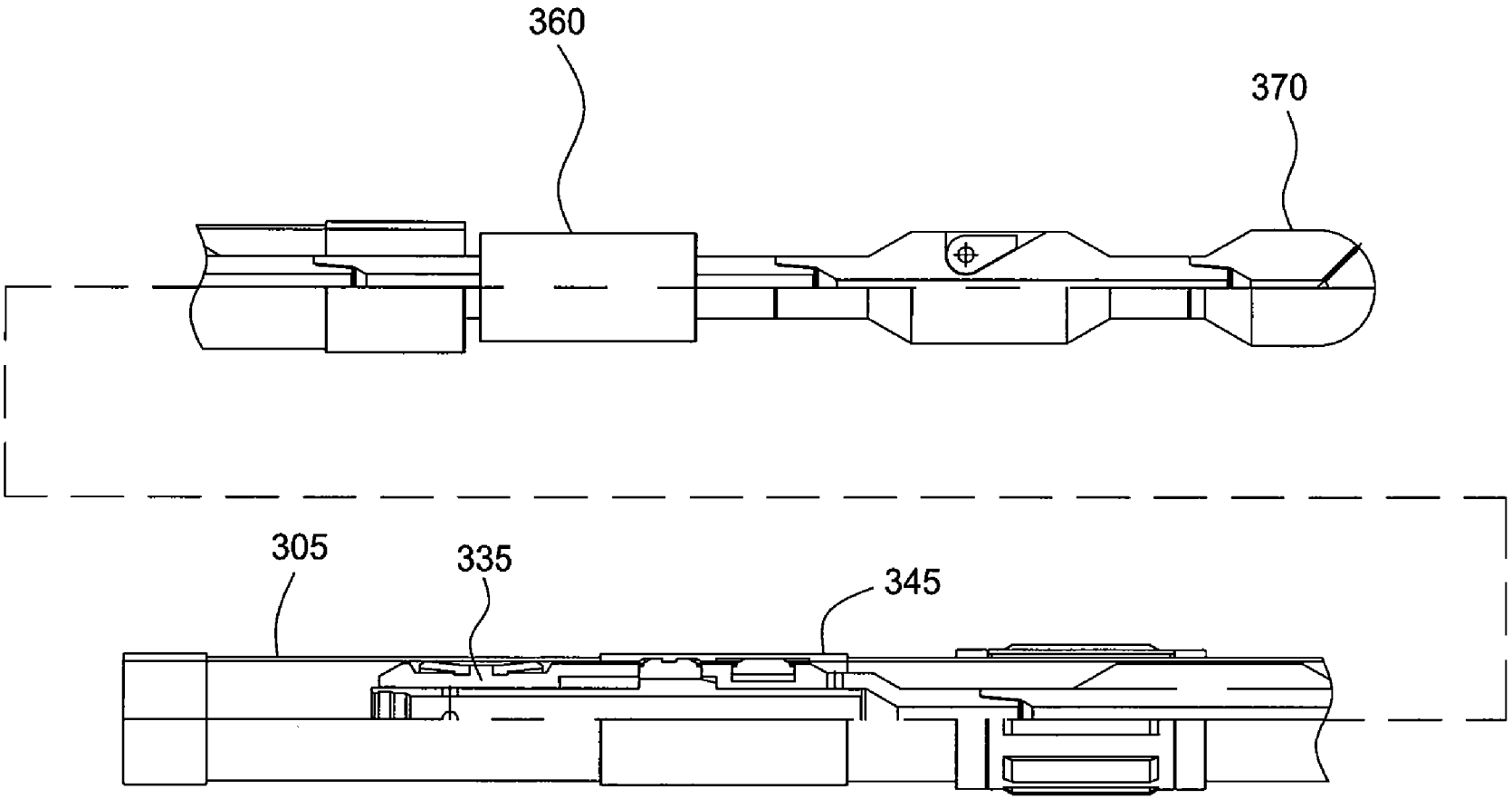
FIGS. 4-8 shows the liner drilling assembly of FIG. 3 in operation.

In operation, a sufficient length of liner 305 with the casing shoe 355 and latch in collar 345 is run so that the casing latch 335 and the BHA 360 may be installed in the liner 305. Then, the remainder of the liner 305 is run in the hole, as illustrated in FIG. 4.

Figure 5:
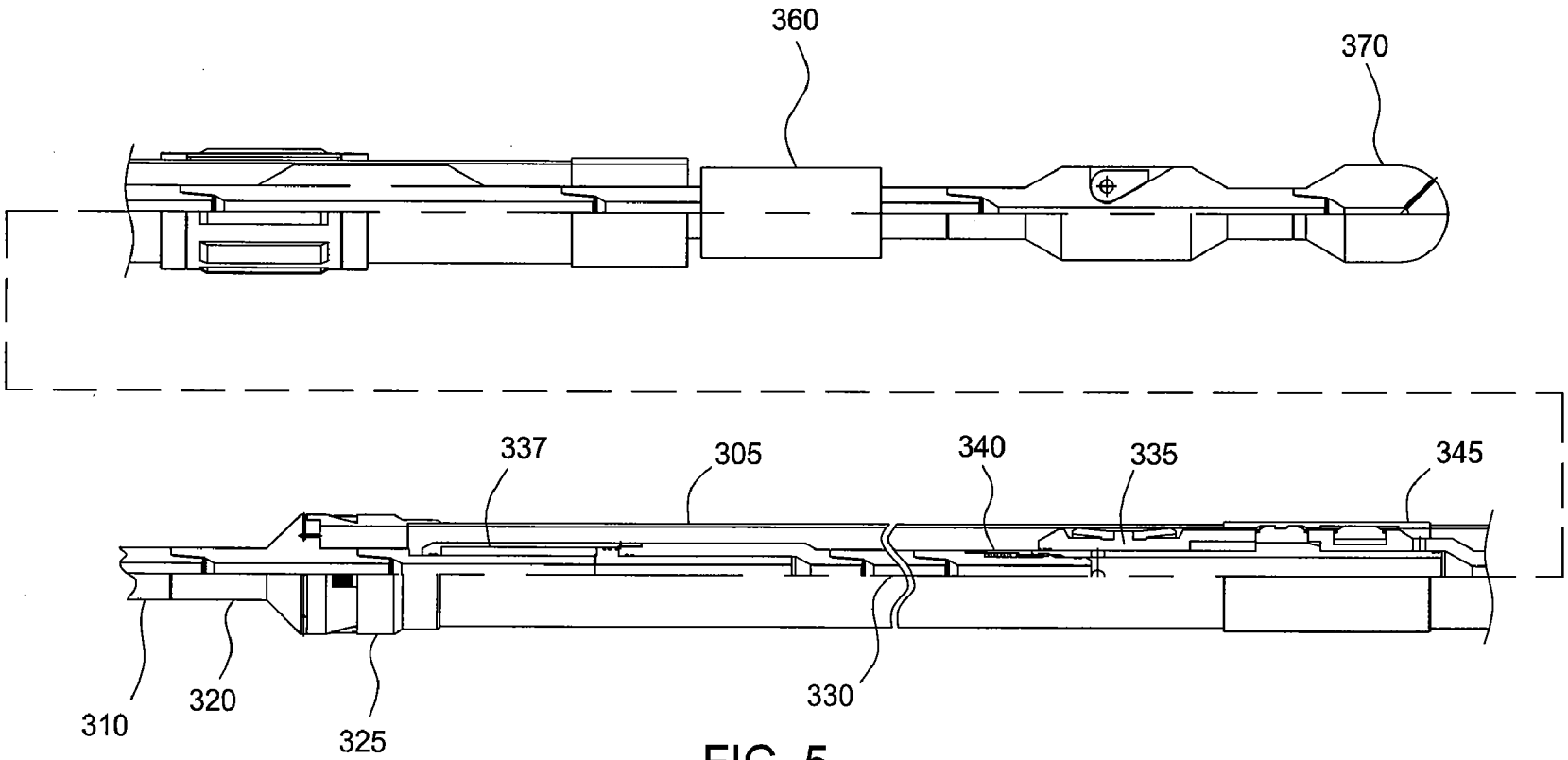

After running the liner 305, the liner hanger 325 is installed on top of the liner 305, as illustrated in FIG. 5. The inner string 330 is run inside the liner 305 with the stab in seal assembly 340 on bottom and the pressure volume balanced slip joint 337 below the running tool 320. The running tool 320 is installed on the end of the inner string 330 and the combined tool 320/string 330 are installed in the liner hanger 325. The drilling assembly is now actuated to proceed to drill to the desired depth. Axial and torsional forces may be transmitted from the drill pipe 310 to the liner 305 through the running tool 320 and the latch 345. In another embodiment, the inner string 330 and the running tool 320 may be connected at the surface and run into the wellbore together for connection with the liner hanger 325. In yet another embodiment, the liner hanger 325, inner string 330, and the running tool 320 may be run in as an assembled apparatus for installation on the liner 305.

Figure 6:
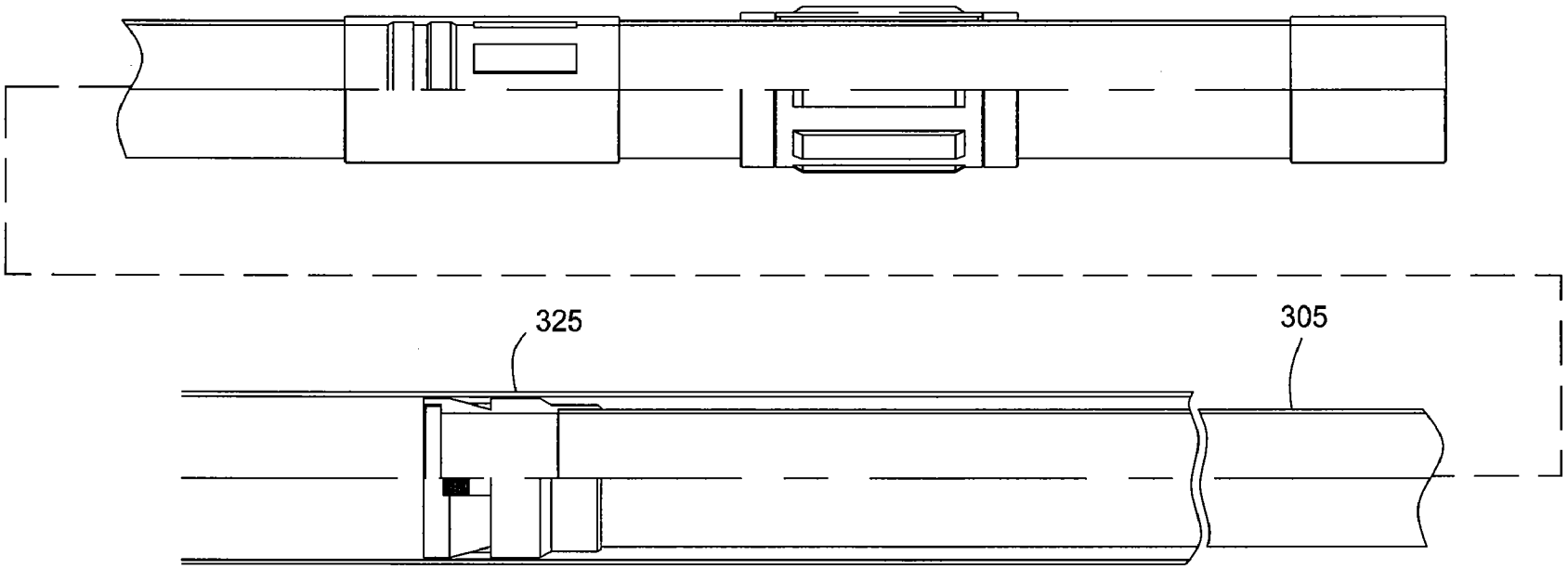

After desired depth is reached, the liner hanger 325 is set. In FIG. 6, it can be seen that the slips of the liner hanger 325 have been radially extended to engage the previously set casing. The setting of the liner hanger also triggers the release of the running tool 320 from the liner 305. After the latch 335 is also released the running tool 320 is pulled along with the inner string 330, casing latch 335, and BHA 360 out of the hole, as illustrated in FIG. 6.

Figure 7:
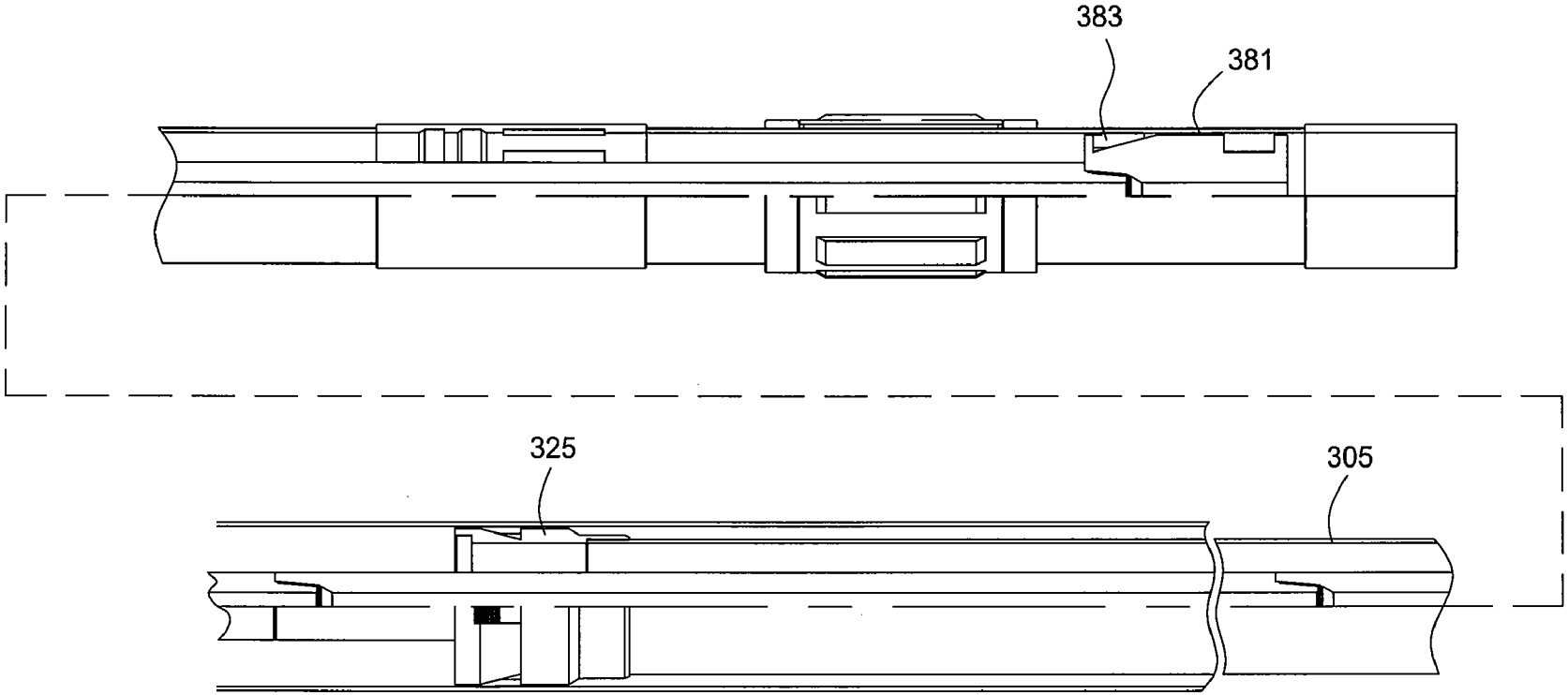

In one embodiment, the cementing operation may be performed by running a first (e.g., 16") packer such as a squeeze packer 381 into the liner 305. The packer 381 may include slips 383 to engage the interior of the liner 305. Thereafter, cement is pumped through the packer 381 to squeeze the bottom of the liner 305, as shown in FIG. 7. In another embodiment, a second (e.g., 20") squeeze packer may be installed in the liner 305 and a cement squeeze is performed at the top of the liner 305. The cement from this second cement squeeze is directed to the annulus between the top of the liner 305 and the liner hanger 325, and into the formation just below the bottom of the previously run casing. In one embodiment, pressure is applied through the drill string to the top of the liner below the packer set in the ID of the previously run casing located above the liner top. This applied pressure is typically referred to as break down pressure. After establishing the break down pressure, cement is pumped in from surface, circulated down, then squeezed into the annulus between the casing hanger and the previously run casing until a suitable pressure is achieve, which is typically higher than pump in pressure (squeeze pressure). In this respect, the higher pressure provides an indication that a cement barrier has been established at the top of the liner.

Figure 8:
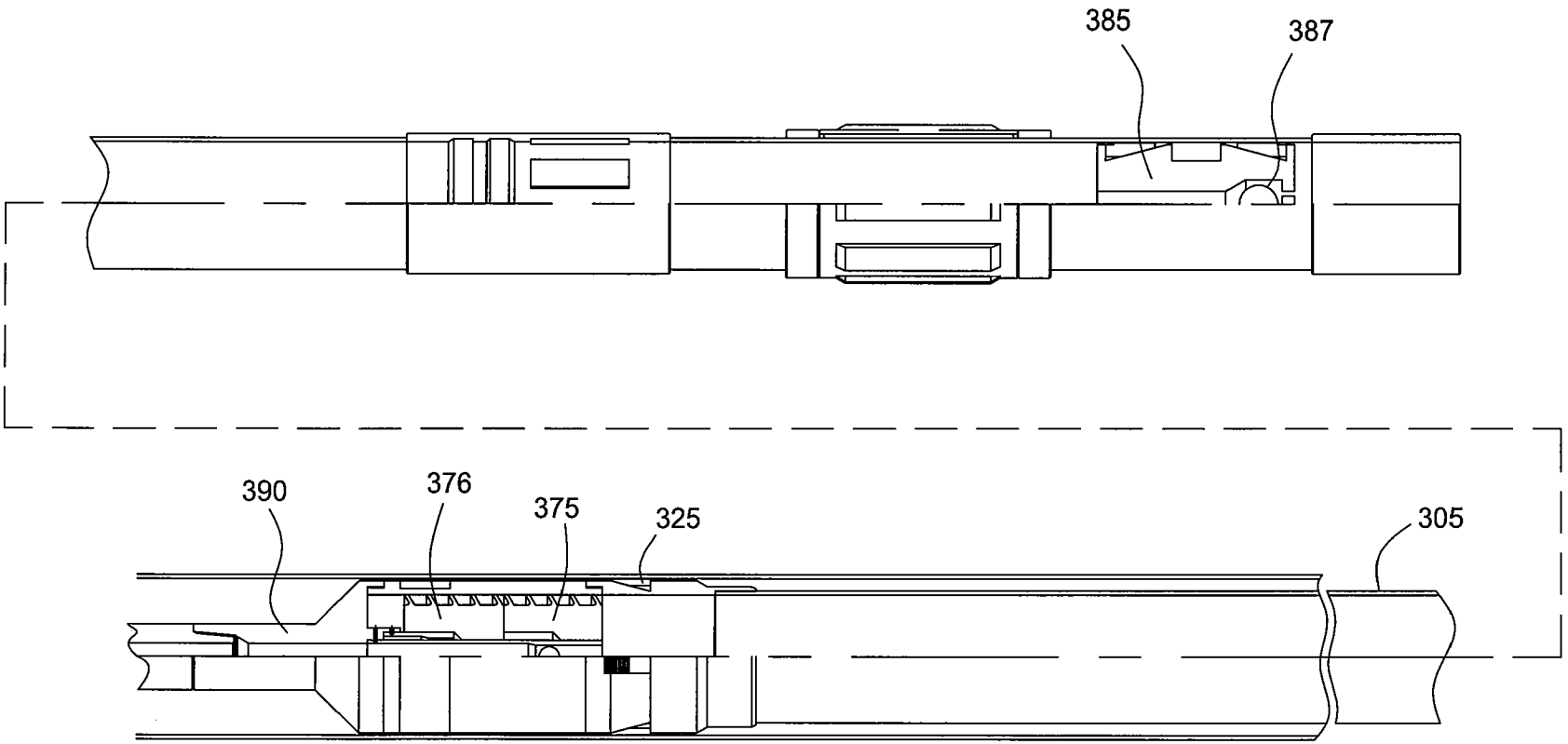

In another embodiment, the cementing operation may be performed using subsurface release plugs 375, 376, as shown in FIG. 8. Initially, a wireline set packer 385 having a check valve 387 is run in and is set near the bottom of the liner 305. Then, a modified running tool 390 containing subsurface release ("SSR") type cementing plugs 375, 376 is positioned on top of the liner 305. A SSR type cementing job is the performed as is known in the art. After cementing, the packing element is set at the top of the liner hanger 325 and the modified running tool 390 is pulled out of the hole.

Figure 9:
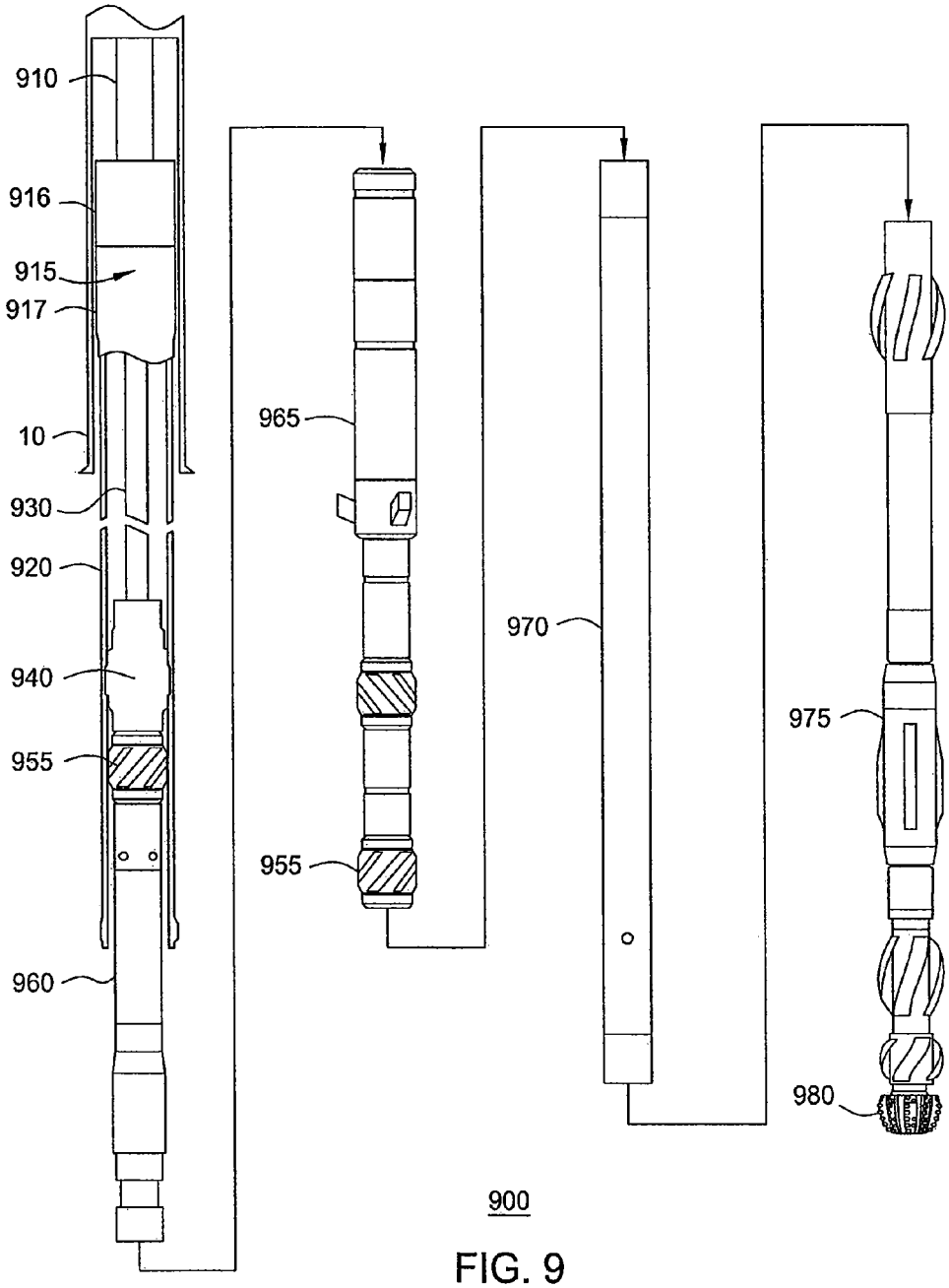
FIG. 9 shows another embodiment of a liner drilling assembly.

FIG. 9 shows another embodiment of a drilling with liner assembly of the present invention. As shown, the drilling liner assembly 900 extends below a previously installed casing 10. The drilling liner assembly 900 is run in on drill pipe 910. A liner drilling tool 916 is used to connect the drill pipe 910 to the liner 920. The liner drilling tool 916 may be a component of the liner top assembly 915, which may also include a liner hanger 917 and a polished bore receptacle ("PBR"). In one embodiment, the liner drilling tool functions as a running tool for connecting the drill pipe 910 to the liner 920. The running tool may include a latch and/or gripping members that may releasably attach and detach from the liner 920. The running/drilling tool is adapted to transmit axial and torsional forces from the drill pipe 910 to the liner 920. The running tool may be released from the liner 920 so that the BHA may be retrieved. Preferably, the running tool has torque capability that equals or exceeds the drill pipe capability and is adapted to endure typical bore hole drilling dynamics. Exemplary running tools are disclosed in U.S. Pat. Nos. 5,613,567, 5,531,273, and 6,032,734, which patents are incorporated herein by reference in their entirety. The liner top equipment (liner hanger and PBR) may also include large radial clearance for cuttings bypass and reduced ECD and setting of liner hanger does not reduce the annular clearance area significantly. In one embodiment, setting of the liner hanger and release of drilling tool may be independent of the differential pressure between the inside of the tool and the outside of the liner to prevent premature activation. In another embodiment, the liner top assembly is not equipped with a packer. In yet another embodiment, the liner top assembly utilizes an expandable liner hanger and/or expandable packers.

An inner string 930 extends from the liner running/drilling tool 916 to a drilling latch 940 below. The inner string 930 may be used to convey fluid from the drill pipe 910 and/or to retrieve the BHA. Also, it should be noted that fluid may be conveyed outside of the inner string, inside of the inner string, or the flow split between both. In one embodiment, the fluid returning to the surface may flow through the annular area between the wellbore and the outer diameter of the liner and/or the annular area between the inner diameter of the liner and the outer diameter of the inner string. The drilling latch 940 is adapted to releasably connect to the liner 920. An exemplary drilling latch is disclosed in U.S. Patent Application Publication No. 2004-0216892, filed on Mar. 5, 2004 by Giroux et al. having Ser. No. 10/795,214, entitled Drilling With Casing Latch, which application is herein incorporated by reference in its entirety. The drilling latch 940 is adapted to transfer axial and torsional forces from the liner 920 to the bottom hole assembly ("BHA"). The drilling latch 940 may be hydraulically, mechanically, or remotely actuated. Suitable actuating mechanism includes mud pulse technology, wire line, and fiber optics.

As shown in FIG. 9, the bottom hole assembly includes one or more stabilizers 955, a motor 960, an under-reamer 965, MWD/LWD 970, rotary steerable systems 975, and a drill bit 980. It must be noted that the BHA may include other components, in addition to or in place of the listed items, such as other geophysical measurement sensors, stabilizers such as eccentric or adjustable stabilizers, steerable systems such as bent motor housing, other drill bits such as expandable bit or bits having nozzles or jetting orifices for directional drilling, or any other suitable component as is known to a person of ordinary skill in the art. Further, the components of the BHA may be arranged in any suitable order as is known to a person of ordinary skill in the art. For example, the under-reamer may be place below the motor and MWD/LWD tool.

While the foregoing is directed to embodiments of the present invention, other and further embodiments of the invention may be devised without departing from the basic scope thereof, and the scope thereof is determined by the claims that follow.

We claim:

1. A method of forming a wellbore, comprising the steps of:
running a liner equipped with a bottom hole assembly ("BHA") into the wellbore using a drill string;
extending the wellbore using the BHA and then suspending the liner in the wellbore at a location below a rig floor;
releasing a tubular member from the suspended liner and retrieving the drill string and the BHA to surface;
running the BHA on the drill string through the suspended liner;
attaching the drill string to the suspended liner;
releasing the suspended liner from the location of attachment; and
advancing the liner and the drill string to further extend the wellbore.

2. The method of claim 1, wherein the liner is suspended below the rig floor using a re-settable liner hanger.

3. The method of claim 1, wherein the liner is suspended below the rig floor within a housing comprising selectively actuatable rams.

4. The method of claim 1 further comprising:
re-suspending the liner below the rig floor;
detaching the drill string from the re-suspended liner; and
retrieving the drilling BHA to the surface.

5. The method of claim 4 further comprising:
running the drilling BHA on a drill string through the re-suspended liner;
attaching the drill string to the re-suspended liner;
releasing the re-suspended liner from the liner's location of suspension; and thereafter advancing the liner through the wellbore on the drill string.

6. The method of claim 1, further comprising retrieving the tubular member to a location above the suspended liner.

7. The method of claim 6, wherein the tubular member and the drill string comprise drill pipe.

8. The method of claim 6, wherein the tubular member is the drill string.

9. The method of claim 1, further comprising repairing the BHA after retrieval and before being run in through the suspended liner.

10. The method of claim 1, further comprising replacing a drill bit of the BHA after retrieval and before being run in through the suspended liner.

11. A method of forming a wellbore comprising:
positioning a ram above the wellbore;
running a liner equipped with a drilling bottom hole assembly ("BHA") into the wellbore;
drilling the wellbore using the drilling BHA and then using the ram to suspend the liner;
retrieving the drilling BHA from the suspended liner;
running the drilling BHA through the liner suspended in the ram;
attaching the drilling BHA to the suspended liner;
releasing the suspended liner from the ram; and then advancing the liner and the drilling BHA by drilling through the wellbore.

12. The method of claim 11 wherein the liner is run in using a conveying member selected from a group consisting of drill pipe, coiled tubing, corod, wireline, and combinations thereof.

13. The method of claim 12, further comprising:
attaching the conveying member to the liner prior to releasing the liner from the liner's location of suspension.

14. The method of claim 12, further comprising:
re-suspending the liner at a different location below the ram;
detaching the drilling BHA from the re-suspended liner; and
retrieving the drilling BHA to the surface.

15. The method of claim 14 further comprising:
running the drilling BHA through the re-suspended liner;
attaching the drilling BHA to the re-suspended liner;
releasing the re-suspended liner from the liner's location of suspension; and thereafter advancing the liner through the wellbore using the conveying member.

16. A method of forming a wellbore, comprising:
running a liner drilling assembly into the wellbore, the liner drilling assembly including a liner, a conveying member, one or more connection members, and a drilling member;
drilling the wellbore using the liner drilling assembly and then suspending the liner in the wellbore;
releasing the conveying member and the drilling member from the suspended liner;
retrieving the drilling member to the surface;
re-connecting the conveying member to the suspended liner;
releasing the liner from the liner's location of suspension; and then
advancing the liner and the drilling member.

17. The method of claim 16, wherein the one or more connection members include a re-settable liner drilling tool.

18. The method of claim 16, wherein the one or more connection members include a drilling latch.

19. The method of claim 16, wherein the conveying member comprises drill pipe.

20. The method of claim 16, wherein suspending the liner comprises activating a re-settable liner hanger.

21. The method of claim 16, wherein suspending the liner comprises activating a ram.

22. The method of claim 16, wherein the one or more connection members include a running tool.

23. The method of claim 16, wherein suspending the liner comprises engaging the liner to a previously set casing.

24. The method of claim 23, further comprising cementing the liner in the wellbore.

25. The method of claim 24, wherein cementing the liner comprises installing a packer in the liner.

26. The method of claim 16, further comprising an extension joint coupled to the conveying member.

27. A method of forming a wellbore, comprising the steps of:
a. providing a liner drilling assembly having a drilling member and a liner connected to a conveying member using one or more connection members;
b. positioning the liner drilling assembly in the wellbore then operating the liner drilling assembly to drill the wellbore, and then attaching the liner to the wellbore;
c. releasing the one or more connection members from the liner, thereby leaving the liner in the wellbore;

d. retrieving the conveying member to a position above the liner;

e. running in the conveying member to reconnect to the liner; and then f. drilling and advancing the liner through the wellbore.

28. The method of claim 27, wherein leaving the liner below the rig floor comprises suspending the liner below the rig floor using a selectively actuatable ram.

29. The method of claim 27, wherein the one or more connection members include a running tool.

30. The method of claim 27, further comprising engaging the liner to a previously set casing after drilling and advancing the liner to a target depth.

31. The method of claim 30, further comprising cementing the liner in the wellbore.

32. The method of claim 31, wherein cementing the liner comprises installing a packer in the liner.

33. The method of claim 30, further comprising advancing the drilling member to a target depth.

34. The method of claim 27, further comprising an extension joint coupled to the conveying member.

35. The method of claim 27, wherein leaving the liner comprises suspending the liner below the rig floor using a re-settable liner hanger.

36. The method of claim 27, further comprising cementing the liner in the wellbore.

37. A method of forming a wellbore, comprising the steps of:

drilling a wellbore while carrying a liner on a drill string; and then attaching the liner to the wellbore at a location below a rig floor, thereby suspending the liner in the wellbore; and then releasing the drill string from the liner; and then reattaching the liner to the drill string; and then releasing the liner from the location of attachment; and then drilling further while carrying the liner.

38. The method of claim 37, wherein the liner is attached to the location using a re-settable liner hanger.

39. The method of claim 37, wherein the liner is attached to selectively actuatable rams.

40. The method of claim 37, further comprising retrieving the drill string and repairing a BHA after retrieval and before releasing the liner from the location of attachment.

41. The method of claim 37, further comprising retrieving the drill string and replacing a drill bit after retrieval and before releasing the liner from the location of attachment.

* * * * *